United States Patent [19]

Lesage

[11] 4,395,598

[45] Jul. 26, 1983

[54] ELECTRO-ACOUSTIC TRANSDUCER CAUSING SOUND WAVES TO BE IN PHASE AT ANY POINT BY PREVENTING REFLECTION FROM THE BACK END OF THE DIAPHRAGM TO STRESS APPLYING MEANS

[75] Inventor: Philippe M. Lesage, Nogent-sur-Marne, France

[73] Assignee: Societe Audax, Montreuil, France

[21] Appl. No.: 212,089

[22] PCT Filed: Nov. 16, 1979

[86] PCT No.: PCT/FR79/00109

§ 371 Date: Jul. 16, 1980

§ 102(e) Date: Jul. 15, 1980

[87] PCT Pub. No.: WO80/01128

PCT Pub. Date: May 29, 1980

[30] Foreign Application Priority Data

Nov. 16, 1978 [FR] France ..... 78 32386

[51] Int. Cl.[3] ..... H04R 9/04

[52] U.S. Cl. ..... 179/115.5 R; 181/172

[58] Field of Search ..... 179/115.5 R, 115, 181; 181/159, 163, 166, 172

[56] References Cited

U.S. PATENT DOCUMENTS

| | | | |
|---|---|---|---|
| 1,726,105 | 8/1929 | Harrison | 181/166 |
| 2,956,636 | 10/1960 | Boersma | 181/163 |
| 3,032,136 | 5/1962 | Hegeman | 181/159 X |
| 3,125,647 | 3/1964 | Rouy | 179/115.5 R |
| 3,424,873 | 1/1969 | Walsh | 179/115.5 R |

FOREIGN PATENT DOCUMENTS

| | | |
|---|---|---|
| 535083 | 10/1931 | Fed. Rep. of Germany . |
| 2112516 | 10/1972 | Fed. Rep. of Germany . |
| 1126904 | 12/1956 | France . |
| 1407123 | 6/1965 | France . |

OTHER PUBLICATIONS

Journal of The Audio Engineering Society; vol. 2, No. 4; Oct. 1954, H. F. Olson; Recent Developments in Loudspeakers; pp. 219–227.

*Primary Examiner*—Stafford D. Schreyer

*Attorney, Agent, or Firm*—A. A. Saffitz

[57] ABSTRACT

The electro-acoustical transducer comprises a membrane flexible or rigid before assembling, the front portion of which has an aperture with a half-angle $\alpha$. In order to obtain sound waves in phase at any listening point, the front portion is the site of vibrations which are responsible for sound emission and are transmitted in the membrane material with a velocity $V_m$ approximating $V_0/\cos\alpha$, where $V_0$ is the velocity of sound in air. The membrane is rigidly attached to the transducer chassis and is tensioned under a tensile stress between 5 and 20 KN, in order to the vibrations be bending transverse waves, the vibrational energy of which is totally transferred to air in form of sound waves before reaching the larger end of the membrane. The mechanical-acoustical output is close to unity and the overall energy output lies between 50 and 80%. The displacement of the rear portion of the membrane into airgap of motor is in the macro-deformation field. The membrane may be cone or dihedron-shaped.

6 Claims, 3 Drawing Figures

ELECTRO-ACOUSTIC TRANSDUCER CAUSING SOUND WAVES TO BE IN PHASE AT ANY POINT BY PREVENTING REFLECTION FROM THE BACK END OF THE DIAPHRAGM TO STRESS APPLYING MEANS

BACKGROUND OF THE INVENTION

1. Field of the Invention

The present invention relates to an electro-acoustic transducer of the loudspeaker-type comprising a membrane which is flexible or rigid before assembling and of which the front portion has an aperture with a predetermined half-angle $\alpha$ and is the site of vibrations responsible for sound emission which are transmitted in the material of the membrane from the motor of the transducer with a velocity $V_m$ such as $V_m \# V_0/\cos\alpha$, where $V_0$ is the velocity of sound waves in air.

2. Description of the Prior Art

In the conventional loudspeakers, the membrane is the seat of standing waves depending upon the frequency to be reproduced. For certain frequencies, the position of nodes and antinodes involves a maximum acoustic radiation in conjunction with resonances and a tone colouration. For other frequencies, the membrane behaviour is inverse and the acoustic radiation is minimum. In this case, if it is considered that the membrane is excited with a same energy, the amplitude of the membrane displacement increases as a total loss; the acoustic radiation impedance becomes wholly reactive. This leads to a low sound output and amplitude distorsions. In this type of loudspeaker, if the excitation in red noise ceases, the energy stored by the membrane is dissipated non-uniformly as a function of the frequency; the loudspeaker displays an acoustic tailing for certain frequencies.

The above-mentioned drawbacks have for consequence an amplitude-frequency response curve undulating at least in the high frequency range of its transmission band and the phase curve ceases to be at minimum. The sound power output of the loudspeaker is relatively low, because a considerable proportion of stored energy in the membrane is not radiated acoustically but dissipated in the form of heat, in particular by negative electrical feedback in the moving voice coil.

Moreover, in the known loudspeakers it is necessary to achieve a compromise between the flexibility of the membrane suspension, the choice of membrane material and the mass of the movable assembly of the motor, on one hand, and the width of the frequency range to be reproduced by the loudspeaker and its electro-acoustical output on the other hand. For the reproduction of frequencies up to medium frequencies, the membrane suspension is generally flexible and the moving emitting mass is large, in order to enable the membrane to move with a large amplitude. For reproducing medium to high audible frequencies, the membrane may by contrast be mounted rather rigidly on the loudspeaker chassis and be of small dimensions, because only the membrane area to the apex of the cone vibrates. Associated with the requirements in this second case, the mass of the movable assembly of the motor must be low, because the vibrational velocity in the membrane becomes high. In order to reproduce sound waves without non-linear amplitude distortions within a wide frequency range, it appears that it is necessary to constrain the geometrical deformations of the membrane to be much smaller than the amplitudes responsible for acoustic radiation, in analogy with the operation for which the membrane moves as an ideal rigid acoustic piston radiator, which is certainly not achieved, at least above a pulsation $\omega_0 = 2\ V_0/a$, where $V_0$ is the velocity of sound in air and a is the radius of the emitting portion of the loudspeaker. Consequently, the construction of a loudspeaker capable of reproducing a wide frequency range is difficult to achieve. This also results from the fact that sound waves generated at any two points along a generatrix of the conical membrane are not in phase at any listening point and that this phase shift is all the more pronounced as the frequencies to be reproduced become higher.

In order to avoid the above-mentioned drawbacks, Lincoln Walsh teaches in U.S. Pat. No. 3,424,873 a loudspeaker such as defined in the first paragraph of the present description. According to this patent, the membrane of the loudspeaker is rigid and is made in glass fibre, paper or aluminium and moreover, has a conventional conical shape.

Operating of this loudspeaker is founded on the fact that, in order to obtain sound waves in phase at any listening point, the vibration velocity $V_m$ responsible of sound energy from the membrane must satisfy the above relation $$V_m \# V_0/\cos\alpha$$

in all the useful audible frequency range. Nevertheless, in order to attempt this relation to be satisfied, it is necessary as much as possible to reduce the reflected waves at the large end of the membrane in such a manner that these waves do not disturb the acoustic radiation produced by the incident waves from the small end of the membrane which is adjacent to the rear portion supporting the voice coil of the electro-mechanical motor of the transducer. In this connection, Lincoln Walsh proposes the vibrations in the membrane to be absorbed gradually from the smaller end to the larger end of the membrane by means of absorbing means such as felt or an elastomeric material which is placed inside the conical membrane, and by means of a very flexible ring-shaped suspension which connects the larger front end of the membrane to the chassis of the loudspeaker. This suspension produces a free axial displacement of the membrane as in the conventional loudspeakers and serves substantially to absorb the vibrating energy for a wide frequency band. This absorption is increased by internal absorbing means which enables also the backward radiated sound waves to be delayed. Additionally, according to other embodiments, in order to weaken the reflection of vibrations at the larger end of the membrane or, in other words, in order that the membrane operates in an analogous manner to an electrical transmission line having a voltage standing wave ratio (VSWR) close to unity (low reflections), the ring-shaped suspension may be constituted by a ring enclosure made of elastomer in which the larger end of the membrane is immersed in a fluid proper to absorb the vibrations. This enables also the load problems of the absorbing means according to the first embodiment to be reduced.

In all cases, although the loudspeaker in accordance with the above-mentioned patent has an acoustical output substantially greater than that of conventional loudspeakers, a non-negligible quantity of the energy of vibrations travelled the membrane is reflected back on the larger end for all the audible frequency range. This occurs mainly from the fact that the vibrations or rattling propagated in the membrane and responsible for the sound energy are transverse waves which belongs to the micro-strain field and act upon the membrane material by shearing. The velocity $V_T$ of these shear transverse waves is given by the relationship:

$$V_T = \sqrt{G/\rho}$$

where G is the shearing elasticity modulus and $\rho$ is the mass per volume unit. Further, for the usual dimensions of the membranes of loudspeakers, it is not possible to obtain transverse waves without correlating with longitudinal waves which are not responsible for sound emission in most cases and act upon the material by compression-expansion. Since the velocity of these waves is comparatively high, such as approximately 5,100 m/s for longitudinal waves and 2,800 m/s for transverse waves in aluminium, a small energy quantity of these waves during their travel up to the front larger end of the membrane is delivered to air in form of sound waves. It follows from this that the above means for absorbing vibrating energy are required in the membrane and particularly at its front end. Additionally to the drawback relative to the cost increase of the loudspeaker caused by the use of absorbing means, the loudspeakers according to the above-mentioned Patent have the disavantages of the conventional loudspeakers among which I will mention a very low acoustical output and a poor acoustical matching of the membrane in all the usable frequency range since the membrane impedance contains an inductive coefficient again.

OBJECT OF THE INVENTION

The main object of this invention is to provide an electro-acoustic transducer in which the vibrations with frequencies higher than the low cut-out frequency which are propagated in the membrane and responsible for the sound energy, have the quasi-totality of their energy which is transferred to air before reflecting at the larger end of the membrane. There is not in the least necessary to absorb the undesirable reflected waves which are produced at the frontal end of the membrane of the above known loudspeakers by suitable means.

SUMMARY OF THE INVENTION

In accordance with the aforementioned object, there is provided an electro-acoustic transducer which is characterized in that all the ends of said membrane are rigidly attached to the chassis of said transducer and in that, after inserting said membrane into said chassis, said membrane is subjected to a tensile stress in order that said sound emission responsible vibrations are bending transverse waves having said velocity $V_m$.

The vibrations responsible for the sound emission are bending transverse waves analogous to ones which are generated in a thin plate from the bending exercising component forces orthogonal to the plate. Whereas the velocity of the above shearing transverse waves is independent of frequency, the velocity $V_b$ of the bending transverse waves varies as a function of the square root of the frequency F of the audio signals to be reproduced according to the relationship:

$$V_b = \sqrt[4]{B/m} \cdot \sqrt{2\pi F},$$

where B is the bending rigidity of the membrane material and m the mass per unit length. The desirable tensile stress is applied from adequate means during the construction of the loudspeaker. For instance, previously, the larger end of the front aperture of the membrane is firmly secured to the chassis of the loudspeaker. Then, the rear edge of the rear portion of the membrane which supports the voice coil of motor, is drawn backwards, which takes place before the attachment of the membrane to the chassis or the forced insertion of the membrane in the airgap of motor through an elastomeric material comparatively rigid. The tensile stress serves to ensure in the open front portion of the membrane a suitable velocity $V_m$ of the bending transverse waves in accordance with the relationship: $V_m \# V_0/\cos\alpha$(sign # means slightly different from).

The direction of this tensile stress is coplanar with the surface of the front portion of the membrane. For a cone-shaped membrane, the tensile stress is distributed colinearly with generatrices of the frusto-conical front portion. For a V-shaped membrane—described hereinafter—the tensile stress is perpendicular to the crest of the dihedron constituting the front portion and is coplanar with both surfaces of the front portion. This tensile stress serves to act on the velocity in accordance with the following relationship; when B equals slightly zero, the velocity $V_p$ becomes:

$$V_p = \sqrt{P/\mu}$$

where P is the modulus of the tensile stress force and $\mu$ the mass per unit length along the direction of the velocity $V_p$ generated by the stress. In this connection, for example, $V_b$ is such as $20 < V_b < 200$ m/s for an aluminum sheet having a thickness of a few 0.1 mm.

The effect of the tensile stress plays a leading part in such a membrane in form of aluminium sheet to obtain a velocity $V_m$ of the bending transverse waves approximately 700 m/s for an angle $\alpha$ close to 60°. Consequently, the incidence of the effect of the frequency F on the velocity $V_b$ is further reduced. The necessary tension P in the front portion of the conical membrane or in each plane of the front portion of a V-shaped membrane can reach 5 k N to 20 kN to fix the size scale.

In the loudspeaker embodying the invention, the sound waves are not generated by an overall displacement of the membrane, but by bending transverse travelling waves (velocity vector of the materials particles being perpendicular to the propagation direction of the waves) due to a displacement in the macro-deformation field. It follows that for frequencies greater than the lower cutoff frequency $f_3$ of the transducer which operates as a high-pass filter, the energy of transverse vibrations which are responsible for sound emission and are propagated within the membrane, is directly dissipated in the air, which involves a possible power output at least ten times higher than that of conventional loudspeakers.

The power output of the loudspeaker designates here the product of the electromechanical output $\eta_{em}$ of the motor which is analogous to an electromechanical transducer and converts the electrical energy of the audible frequency electrical signal into vibrating mechanical energy, by the mechanical-acoustical output $\eta_{ma}$ of the membrane which is analogous to a mechanical-acoustical transducer and converts the vibrating mechanical energy into acoustic energy in the form of sound waves propagated in air. The electro-mechanical output $\eta_{em}$ is maximum owing to the fact of the quasi-static use of the force which is delivered from the electromagnetic motor. In other respects, for frequencies higher than $f_3$, the impedance matching is maximum and the emitting area constituting the front portion of the membrane is also greater than that exactly required by the radiation. It follows from this that the quasi-totality of the vibrating energy has been transferred to air before reflecting against the large front end of the membrane secured to the chassis. The mechanical-acoustical output is substantially equal to unity for frequencies higher than $f_3$. The result is that the overall energy output is optimum and quasi equal to the electromechanical output $\eta_{em}$, i.e. approximates 50 to 80%. This high energy output is out all of proportion to the output of the conventional loudspeakers including the loudspeakers disclosed by the above mentioned U.S. patent which can be evaluated to 1% about.

These performances are possible if care is taken at the outset to select the dimensions and a structure of the membrane such that the vibrating energy of the wave propagated from the rear end, i.e. from the side of the voice coil of the motor, toward the front end be dissipated in acoustic radiation before reaching the frontal end of the membrane, i.e. that there is no undesirable reflection at the frontal end for a predetermined low cutoff frequency.

As already stated, the membrane of the transducer may be embodied in the conventional manner in the form of a revolution conical surface having a rectilinear generatrix or substantially analogous to a conic. In this case, the motor will have a traditional cylindrical structure. Its axis is that of the membrane and its movable assembly comprises a cylindrical hollow former which extends towards the rear the small base of the conical portion of the membrane and supports the voice coil. The displacement of the movable assembly of the motor is always such that it falls in the range of small movements in the physical sense of this term.

According to a second mode of embodiment, the front portion of the membrane of the transducer is of dihedron shape. The dihedron is open forwards and is constituted by two identical surfaces which are substantially plane and rectangular or square. The rear portion of the membrane is rectangular or square plane surface which coincides with the symmetry plane of the dihedron, is fast with the crest of the dihedron and supports the voice coil centered in the airgap of the motor. The voice coil of this transducer is of type already used for motors of known loudspeakers having an entirely plane membrane (French Pat. No. 1,407,123 and German patent application No. P 1,437,469). It is advantageously rectangularly wound and is either printed on the rear portion of the membrane or is obtained by the winding of a flat wire which is attached, for example, by adhesive, to the rear portion of the membrane. In general, all the large sides of the coil turns are inserted in two airgaps which are oppositely magnetised and formed by the polar members of the motor, whilst the small sides of the coil turns serve as current return. According to a first embodiment, the rear portion of the membrane is connected to the rear of the transducer chassis by means of a rigid suspension which is substantially coplanar with the symmetry plane of the dihedron and is optionally adjustable in longitudinal position. The suspension serves in particular to tension the membrane in order to obtain the desired dihedron half-angle $\alpha$ as well as an appropriate propagation velocity $V_m$ of the bending transverse vibrations in dependence of the selected membrane material. According to a second embodiment, the rear plane portion of the membrane is centered in the airgap or airgaps of the motor by means of an elastic material inserted with force between said rear portion and the polar members. In this case, the membrane is preferably rigid.

BRIEF DESCRIPTION OF THE DRAWING

Other features and advantages of the present invention will be apparent from the following description of several examples of embodiment as illustrated in the corresponding accompanying drawings, in which.

DESCRIPTION OF THE PREFERRED EMBODIMENTS

Figure 1:
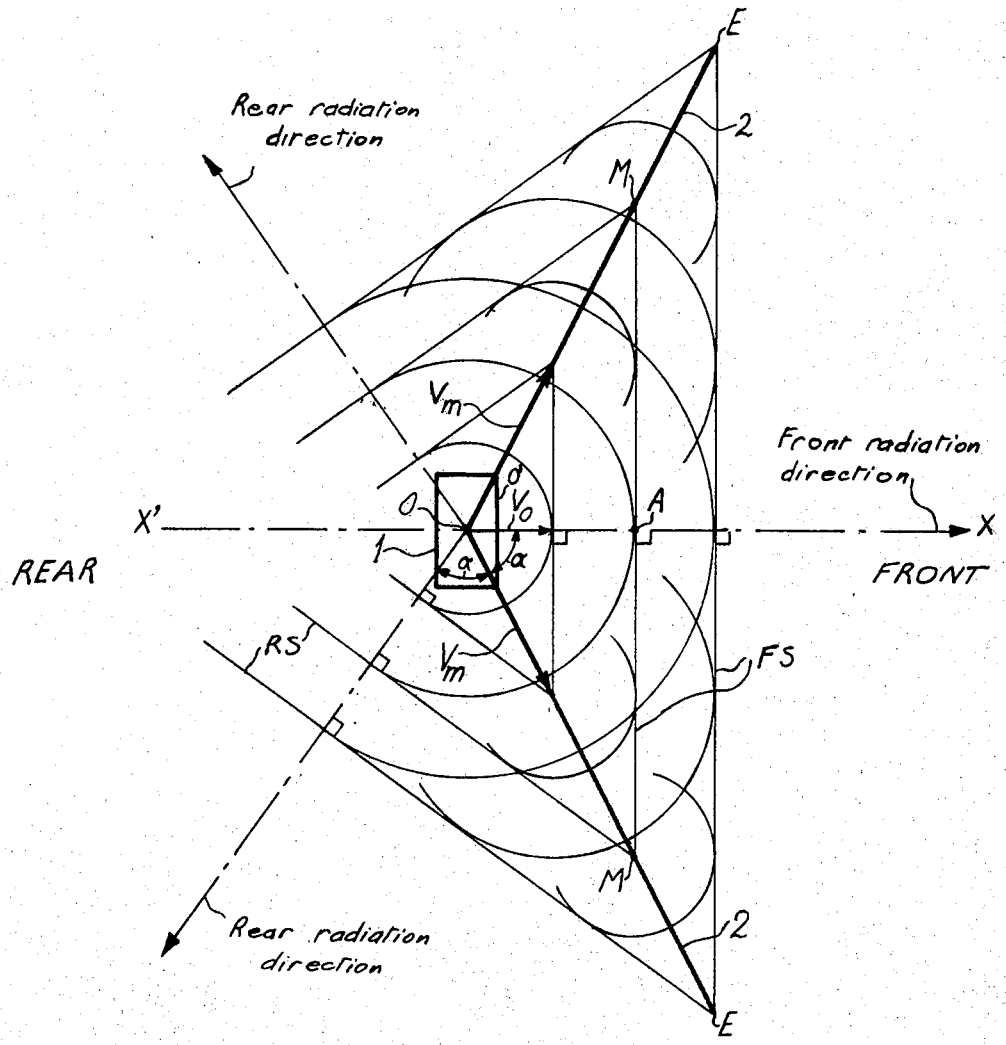
FIG. 1 is a schematical diagram showing the propagation of subtantially plane sound waves emitted by an electro-acoustic transducer embodying the invention.

FIG. 1 shows schematically the general dihedral configuration which must prevail, coplanar to the symmetry axis or symmetry plane X'X of the airgap of motor 1 of the electro-acoustic transducer or loudspeaker, on at least one longitudinal section of the membrane 2 embodying the invention. This membrane is of one of the two following principal shapes or derives of the combination of these:

linear shape constituted by the intersection of two substantially plane identical surfaces which are rectangular or square and which form a dihedron having a rectilinear vertical crest O symmetrical relative to the plane X'X and having two straight ends E parallel to the crest O and equidistant from the plane X'X; and conventional shape of revolution constituted by a frusto-conical surface which has preferably rectilinear generatrix, is centered on the axis X'X and has a large front base E and a small rear base O' extended coaxially to the axis X'X by a mandrel carrying the voice coil in the motor 1 having a cylindrical structure.

The velocity vector $V_O$ of sound waves in air and the velocity vector $V_m$ of the bending transverse vibrations in the material of the membrane which is greatly tensioned under tensile stresses of 5 k N to 20 k N approximately, are similarly represented at the apex O of the longitudinal section. The vector $V_O$ is colinear with the axis X'X or perpendicular to the crest O and coplanar with the plane X'X, whilst the vector $V_m$ is colinear with a generatrix of the section of the membrane 2. According to the invention, the propagation time of the bending transverse waves which are transmitted by the very small displacement of the voice coil in the airgap of the motor 1 to reach any point M of the generatrix of said longitudinal section, is substantially equal to the propagation on time of the sound wave imparted to the air from the apex O of the membrane (or of the small base O') to reach a point A on the axis (or the plane)

X'X at right angles to the point M. In consequence, this condition is satisfied when the following relation is achieved:

$$V_m \cos \alpha \# V_O \quad (1)$$

where $\alpha$ is the half-angle at the apex of the membrane 2. As shown in FIG. 1, the equiphasal surfaces FS of the sound radiation generated by the vibrations of the membrane are plane and perpendicular to the direction X'X of the forward and central radiation of the loudspeaker. Thus, a listener situated in front of the loudspeaker perceives the sound waves emitted by every point of the membrane which are in phase. The membrane behaves like an ideal flat acoustic piston radiator.

According to the invention, the material constituting the membrane is selected in such a manner that, after drawing the membrane at its ends with a high tensile stress, the velocity $V_m$ satisfies the relation (1) for a given half-angle $\alpha$ at the apex which is preferably relatively large, in order to obtain a loudspeaker of shallow depth. FIG. 1 also shows the equiphasal sound radiation surfaces RS which are transmitted towards the rear of the loudspeaker.

Since the sound emission is due to the propagation of a progressive vibration in the drawn membrane which generates a plane sound wave, i.e. without total displacement of the membrane 2, contrary to the conventional loudspeakers, the membrane 2 operates in a manner analogous to a mechanical transmission line the limit of which is constituted by the large frontal end E of the membrane 2. In this connection, from the practical point of view, the dimensions of the front portion of the membrane and particularly the length of its generatrix along which the high tensile stress acts and the bending transverse waves propagate with velocities close to 700 m/s, are selected in such a manner that all the vibrational energy is converted into sound energy before the bending transverse waves reach the large end E of the membrane. Consequently, the limit conditions at the end E are not to be taken into account and no vibration absorbing and damping means is provided at the end E. In this connection, the end E of the front portion of the membrane and the rear edge of the rear portion of the membrane which supports the voice coil of the loudspeaker motor are rigidly attached to the chassis of the loudspeaker directly or through a rigid or tensioned spring suspension. The membrane can be flexible, semi-rigid or even rigid. In all cases, the dimensions and the propagation characteristics of the membrane will be preferably so selected as to achieve the adaptation of the characteristic impedances of the membrane and the air in order to obtain a maximum of acoustic radiation, i.e., a high mechanised-acoustical output $\eta_{ma}$ close to unity. In other words, it is necessary that the vibrational energy of the vibrations in the membrane be totally dissipated in the form of sound emission before reaching the front end E of the membrane. From what precedes, it appears that for the frequencies greater than the lower cut-off frequency of the loudspeaker the membrane embodying the invention is not the seat of standing waves, in contrast to that of the known loudspeakers. This contributes in particular to better directivity characteristics, a better transient response and to a suppression of sound tailing. An extension of the transmission band towards lower frequencies is possible in particular by a relative increase of the emitting surface of the loudspeaker membrane.

Figure 2:
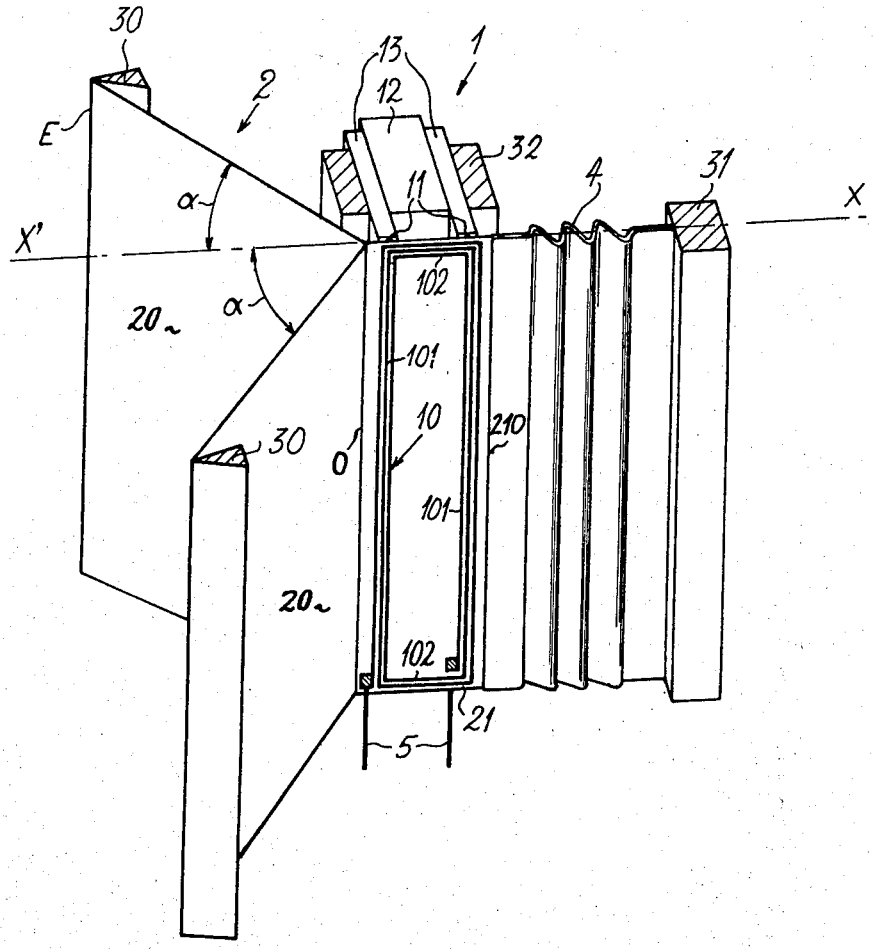
FIG. 2 is a perspective view of the essential parts of a loudspeaker with dihedral membrane and rear suspension.
Figure 3:
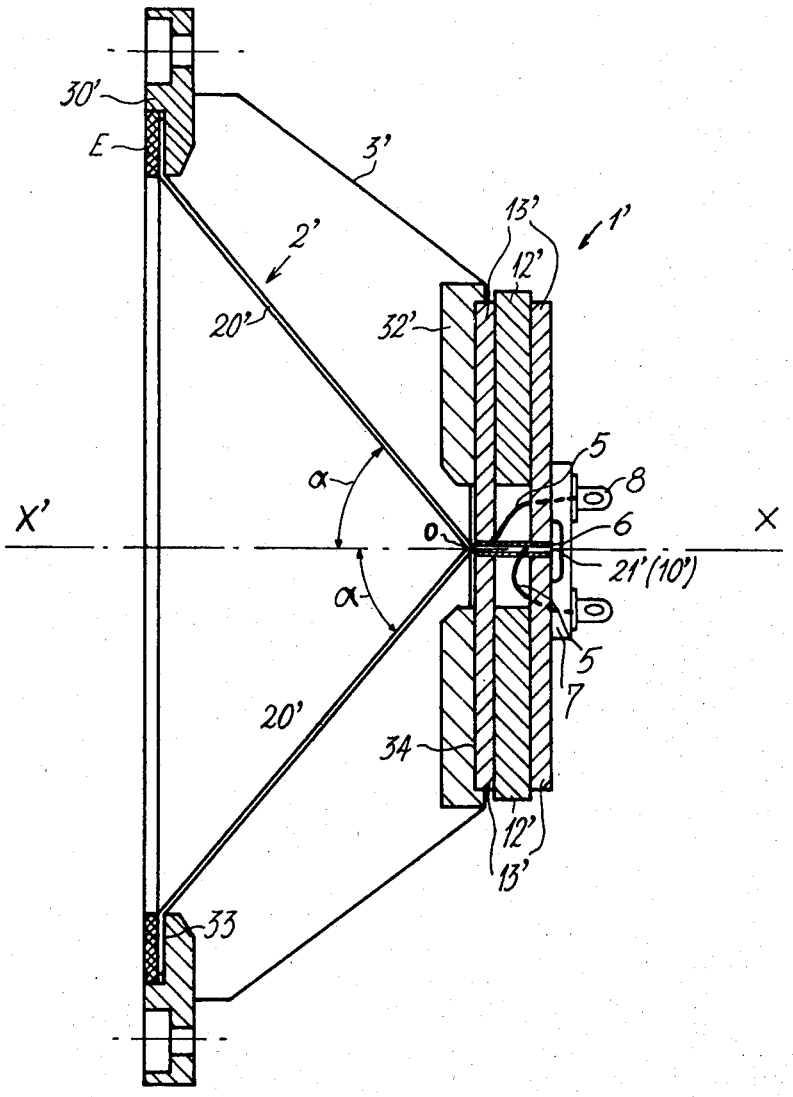
FIG. 3 is a longitudinal and horizontal plan view of a loudspeaker with dihedral membrane without rear suspension.

Referring now to FIGS. 2 and 3, two embodiments of the electro-acoustic transducer of the loudspeaker type having a membrane in the shape of dihedron or a V are shown schematically according to the invention. Although this novel type of loudspeaker is described in detail in the following, it will be noted that the other loudspeakers with revolution membrane which also fall within the scope of the invention, can be derived by those skilled in the art from the shape of the known membranes, such as the frusto-conical membrances, and from the combination of the known motors and those described with reference to FIGS. 2 and 3.

FIG. 2 relates to a loudspeaker having a rigid or flexible membrane 2 which is tensioned by a high tensile stress and of which the two frontal ends E of two plane rectangular or square surfaces 20 shaping the dihedron are rigidly attached to a rectangular or square front frame 30 of the loudspeaker chassis. The necessary tightness for separating the front and rear sound waves is ensured by fitting of the edges of the surfaces 20 to the chassis. In order not to overload the FIGS. 2 and 3, the chassis is shown only in part. The rear plane surface 21 is shown in rectangular shape and is coplanar with the vertical plane of symmetry X'X of the dihedron, extends rearwards the crest O of the dihedron and is symmetrically cased in the airgap of the motor 1, which here has a symmetrical structure. It is thus seen that the electro acoustical transducer comprises the membrane 2 in the shape of the dihedral or V form and that the front end E is the site of vibrations responsible for sound emission, the vibrations being transmitted in the material of the membrane from the motor 1 with velocity $V_m$ such that $V_m \# V_O/\cos \alpha$ where $V_O$ is velocity of sound in air and $\alpha$ is the half equal at the aperture of the dihedral membrane. All of the edges at the ends E and end 210 of membrane 2 are rigidly secured to chassis 30–31 so that after inserting the membrane into the chassis the membrane is then subjected to a tensile stress at the edges in order that the sound emission which results constitute vibrations obtained in the form of bending transverse waves having a velocity of $V_m$. As shown in FIG. 2 the electro acoustical transducer utilizes a tensioned elastic suspension 4 which is in the form of a continuous single bellows type sheet at the rear face 210 of the membrane. Between the rear portion 21 of the membrane and the motor 1 there is provided an air gap 11 and this rear portion 21 is centered in the air gap by means of this elastic element 4 which is inserted forcibly between the rear portion 21 and the poles 13 of the motor 1 (see FIG. 2). Thus, from the embodiment illustrated in FIG. 2 it is seen that the front portion 20 of the membrane forming the dihedron comprises two identical rectangular or square surfaces while the rear portion 21 of the membrane having the same rectangular or plane surface which corresponds to the front supports the voice coil 10 which is placed in the center of the air gap 11 of the motor 1 and this placement provides the plane of symmetry X'—X which is shown for the dihedron in the axis shown in dotted line in FIG. 2.

The chassis 30–31 secures the lateral edges of the dihedron in FIG. 2 by the placement of the elements 30 directly behind each lateral edge as shown in the Figure and by the placement of the rear element 31 behind the tensioned elastic suspension 4 at the rear edge of said suspension 4. The chassis as shown in FIG. 2 has a front rectangular plane surface 20 and a rear surface 21. The vertical plane of the symmetry of the dihedron is X'—X and immediately behind the vertex of the V of the dihedron the rear plane surface 21 presents a plane which lies in the vertical plane of symmetry identified as X'—X of the dihedron. The corrugated suspension 4 also lies in this plane and the obvious advantage of rigid attachment between edge 210 and rear chassis member 31 is achieved because of the alignment of the suspension 4 in this plane of symmetry X'—X. The rear edge 210 of the rear surface 21 is connected to a rear member 31 of the chassis by means of a corrugated rigid or initially elastic suspension 4 which is practically coplanar with the plane X'X. An adjusting device, here not shown, makes it possible to anchor the suspension 4 to the chassis in order to enable the longitudinal displacement of the membrane-suspension assembly 2-4 and, in consequence, the adjustment of the tensile stress of the membrane 2 in order to obtain the velocity of the bending transverse waves $V_p$ such as $V_{m(Vf,\ Vp)}\#V_0/\cos\alpha$. Naturally and inversely according to another embodiment, two rigid or initially elastic suspensions may be provided for connecting the two ends E of the front membrane portion to the front frame 30 through the adjusting device, and the rear edge 210 may be attached rigidly and directly to the rear member 31.

Preferably, the material constituting the membrane 2 must satisfy the following conditions, additional to the condition imposed by the relation (1):

no creep in the membrane during the operation of the loudspeaker;

very high $E/\mu$ ratio of the Young modulus E of the material and of the mass per unit area $\mu$ of the material;

internal damping of the material close to the critical value; and a very high $\sigma/\mu$ ratio of modulus of tensile elasticity $\sigma$ in elastic range and of the mass per unit area $\mu$.

It will be also noted that the connection of the rear portion 21 and of the emitting portion of the membrane constituted by the dihedron 20 must be rigid and have properties approximating those of the rear portion supporting the voice coil. Moreover, the mass of the above connection and of the rear portion 21 is not very critical, owing to the nature of the mechanical transmission impedance at the level of the rear portion.

In accordance with the embodiment shown in FIG. 2, the motor 1 of the loudspeaker comprises a movable assembly constituted by a plane voice coil 10 which is rectangularly wound and is obtained by serigraphy or by winding and cementing of a rectangular cross-section wire on the faces of the rear surface 21 of the membrane. The conductor strips 101 forming the large sides of the turns of the voice coil 10 alone generate an induction in the magnetic circuit of the motor 1. They are perpendicular to the direction of the small displacements of the membrane 2 and are centered in the two oppositely magnetised airgaps 11 of motor 1. The terminals of the internal and external turns of the voice coil are welded to two leads 5 which are connected to known electrical audio frequency signal producing means. The conductor strips 102 forming the small sides of the voice coil turns are parallel to the displacement of the coil between the airgap 11 and serve merely for current return.

The stationary portion of the motor 1 —half of which is shown in FIG. 2—comprises for example two parallelepipedal permanent magnets 12 which are sited symmetrically on either side of the plane X'X and which are braced by two pairs of flat polar members 13. The large conductor strips 101 of the voice coil 10 are inserted centrally into the two airgaps 11 formed by the four polar members 13. The assembly of the stationary portion of the motor is attached to the interior of a double rectangular central frame 32 of the loudspeaker chassis.

In such a loudspeaker embodying the invention, the "displacements" of the voice coil 10 are very small and induce "displacements" of the membrane 2 falling in the macro-deformation range in order to achieve that the membrane be the site of mainly transverse vibrations generating directly a sound pressure in the air with a quasi-absence of membrane displacement; on the other hand, the forces applied are relatively large.

The main advantageous features of such a loudspeaker are as follows:

behaviour similar to that of a linear quadripole and acoustic doublet radiation;

amplitude-frequency response curve having a second-order function analogous to that of a high-pass filter with the cutoff frequency $f_3$;

minimal phase-response curve;

extended monotonous frequency response curve, i.e. having no ripples ranging from medium frequencies of the order of kHz to beyond audiofrequencies, i.e. beyond 100 kHz;

very high possible mechanical-acoustical output close to unity in this frequency range and whole energy output up to ten times greater than that of the conventional loudspeakers;

generation of soundwaves along surfaces which are substantially plane and orthogonal to the symmetry plane X'X of the dihedron, which confers a low directivity in the horizontal plane and a functioning analogous to an ideal flat sound piston radiator;

analogy of the loudspeaker to a quasi-resistive impedance load relative to the output terminal of the associated amplifier.

The loudspeaker shown in FIG. 3 is of the same type as that of FIG. 2 with the difference that the rear portion 21' of the membrane 2' is here not connected to the chassis by means of an elastic suspension 4. In fact, the rear portion 21' of the membrane 2' supporting a flat rectangularly wound voice coil 10' is centered in the two airgaps 11' which are formed by the four polar members 13' of the motor 1', by means of a thin layer of an elastomer 6. During assembling, the rear portion 21 is hold drawn under action of a high tensile stress by adequate mechanical means and is forced into the airgaps simultaneously with the elastomeric layer 6 which is sandwiched. According to the embodiment shown in FIG. 3, it may be provided additionally with a suspension which is analogous to that 4 shown in FIG. 2 and which connects rigidly the rear edge of the rear portion 21' to a rear chassis member such as 31.

As shown in FIG. 3, the structure of this loudspeaker is made up of components which are substantially analogous to that of FIG. 2 and which are referenced by indexed numerals. The chassis 3' has a front frame 30' which is rectangular or square and which has a shoulder 33 to which is bonded the front peripheral end E' of the membrane 2'. The rectangular or square central frame 32' also has a shoulder 34 adapted for centering the two frontal polar members 13', i.e. the assembly of the stationary portion of the motor. As in FIG. 2 where it is partially shown, the chassis 3 or 3' is made up for example of aluminium casting and supports the frames 30' and 32' and also, as in FIG. 2, the rear member 31. Lastly, an insulating support 7 is mounted on the rear portion. Feed plugs 8 of the loudspeaker coil 10 are inserted into the insulating support 7 and are connected to feed leads 5' for the voice coil 10'. The insulating support 7 is fastened to the rear pair of polar members 13'.

In this second embodiment, the membrane 2' is preferably rigid. The elimination of the suspension 4 shown in FIG. 2 makes it possible to eliminate any stray reflections at the rear of the membrane and also contributes to a simpler, faster and less costly assembly.

Although the invention has been particularly described with reference to two preferred embodiments, it will be understood by those skilled in the art that the foregoing and other changes in form and in details may be made therein without departing from the spirit and scope of the annexed claims. Thus, in the case of a membrane such as that shown in FIG. 2 or 3, one or more suspensions such as the suspension 4 may also connect the frontal end E of the membrane to the frontal frame 30 or 30' of the chassis and possibly to means for regulating the tension of the membrane. According to all preceding cases, the membrane may have a surface area of several square decimetres, in order to radiate not only in the medium and high frequency range, but also in the low frequency range. Lastly, according to other embodiments, the voice coil 10 or 10' relative to a dihedral structure may have only one set of conductor strips between two polar members forming the single airgap of the motor. Moreover, this voice coil may be composed of inductors printed on the two faces of the rear portion of the membrane inserted into the airgap or airgaps, and may also be of the multi-layer type or similar depending on the inertia of the employed movable portion; it may also be obtained by multi-layer winding of flat wire in one, two or several turns built on the coil support. Moreover, the motor of the loudspeaker embodying the invention may be of the piezoelectric or electrostatic type.

What I claim is:

1. An electro-acoustical transducer comprising:

a motor for imparting vibrations to a shaped membrane;

a shaped membrane in the form of a dihedron constituting the site of vibrations responsible for sound transmission, said dihedron having a predetermined half angle $\alpha$ to transmit said vibrations from said membrane at a velocity $V_m$ being approximately equal to $V_0/\cos\alpha$ where $V_0$ is a velocity of sound in air;

said membrane having two side edges, a front end and a rear end, the front end constituting the two front surfaces of the dihedron, the rear end constituting the rear surfaces of the dihedron, and the side edges adapted for secure attachment to the chassis at the rear of the membrane;

a chassis having front and rear portions constituting the supporting structure for said motor and said membrane;

an air gap defined between the intersecting planar surface of the dihedron which constitutes the rear end of said membrane and the moving portion of said motor, and the stationary portion of said motor which is spaced from said membrane which is fixed by said chassis with the membrane centered in said air gap;

said chassis centering said air gap which is located at the center of said membrane along a plane of symmetry passing through the vertex of the dihedron along the fold of the dihedron and adjacent said motor whereby the plane of symmetry bisects the angle of the dihedron to provide the predetermined angle $\alpha$ and permits the placement of a stress tensioning means to apply stress to the front of the membrane from a position behind the membrane and attached to the rear portion of said chassis;

securing means on the front portion of said chassis between the front end of said membrane and the rear portion of said chassis for securing the membrane to the chassis;

said securing means including a stress-tensioning means connected between the front part of said membrane and the rear portion of said chassis to apply a tensile stress to the front of said membrane whereby after said membrane is inserted into said chassis with the bolt of the dihedron in proper relation to said air gap and motor, said stress tensioning means lies along the plane of symmetry extending through the vertex of the dihedron through to the back portion of said chassis and the tensile stress provides membrane vibrations in the form of bending transverse waves having the velocity $V_m$, said tensile stress applying means also preventing reflection of sound waves from the back end of the membrane.

2. An electro-acoustical transducer as claimed in claim 1 wherein said tensile stress applying means is in the form of a corrugated sheet which lies in the plane of symmetry of the dihedron.

3. An electro-acoustical transducer as claimed in claim 2 wherein said motor comprises poles which constitute a planar boundary surface of the motor adjacent said air gap and wherein a front edge of said tension applying means is inserted adjacent the pole of said motor and the air gap to secure said membrane under tension at the front edge to form bending transverse waves of velocity $V_m$.

4. An electro-acoustical transducer as claimed in claim 3 wherein said dihedron has two identical rectangular or square plane surfaces.

5. An electro-acoustical transducer as claimed in claim 3 wherein said tensile stress applying means is introduced behind the rear end of said membrane whichis in the air gap and adjacent the pole, by forcible insertion of said rear end into said air gap while assuring that the membrane is centered in relation to the air gap and that the tensile stress applying means lies along the plane of symmetry of the dihedron.

6. An electro-acoustical transducer as claimed in claim 5 wherein the tensile stress applying means tensions said membrane to a value of 5 to 20 k N.

* * * * *